US007861398B1

(12) United States Patent
Mehta et al.

(10) Patent No.: US 7,861,398 B1
(45) Date of Patent: Jan. 4, 2011

(54) METHOD FOR FABRICATING A MINIATURE TUNABLE FILTER

(75) Inventors: Sarabjit Mehta, Malibu, CA (US); Peter Petre, Oak Park, CA (US)

(73) Assignee: HRL Laboratories, LLC, Malibu, CA (US)

( * ) Notice: Subject to any disclaimer, the term of this patent is extended or adjusted under 35 U.S.C. 154(b) by 204 days.

(21) Appl. No.: 12/142,580

(22) Filed: Jun. 19, 2008

Related U.S. Application Data

(63) Continuation-in-part of application No. 11/166,032, filed on Jun. 23, 2005, now Pat. No. 7,405,637.

(51) Int. Cl.
*H01Q 13/00* (2006.01)

(52) U.S. Cl. ..... 29/600; 29/830; 29/846; 29/852; 333/205; 333/207; 333/231; 333/232; 333/233

(58) Field of Classification Search ..... 29/602.1, 29/830, 846, 852, 600; 333/207, 255, 203, 333/205, 235, 231, 232, 233
See application file for complete search history.

(56) References Cited

U.S. PATENT DOCUMENTS

| | | | | |
|---|---|---|---|---|
| 4,450,421 | A * | 5/1984 | Meguro et al. | 333/202 |
| 4,757,284 | A | 7/1988 | Ueno | 333/203 |
| 5,406,233 | A | 4/1995 | Shih et al. | 333/161 |
| 5,461,003 | A | 10/1995 | Havemann et al. | 438/187 |
| 5,510,645 | A | 4/1996 | Fitch et al. | 257/522 |
| 5,550,519 | A | 8/1996 | Korpela | 333/207 |
| 5,738,799 | A | 4/1998 | Hawkins et al. | 216/27 |
| 5,853,601 | A | 12/1998 | Krishaswamy et al. | 216/2 |
| 5,888,942 | A | 3/1999 | Matthaei | 505/210 |
| 6,251,798 | B1 | 6/2001 | Soo et al. | 438/758 |
| 6,287,979 | B1 | 9/2001 | Zhou et al. | 438/723 |
| 6,516,208 | B1 | 2/2003 | Eden | 505/210 |
| 6,791,430 | B2 | 9/2004 | Borzenets et al. | 333/17.1 |
| 2002/0020053 | A1 | 2/2002 | Fonash et al. | 29/623.1 |
| 2004/0197526 | A1 | 10/2004 | Mehta | 428/156 |

OTHER PUBLICATIONS

Barker, N.S., "Distributed MEMS True-Time Delay Phase Shifters and Wide-Band Switches," *IEEE Transactions on Microwave Theory and Techniques*, vol. 46, No. 11, pp. 1881-1890 (Nov. 1998).

* cited by examiner

*Primary Examiner*—Derris H Banks
*Assistant Examiner*—Azm Parvez
(74) *Attorney, Agent, or Firm*—Ladas & Parry

(57) ABSTRACT

A method for fabrication of a filter includes forming an input transformer pole in a first substrate by forming a first conductive via, forming an output transformer pole in the first substrate by forming a second conductive via, forming one or more filter poles in the first substrate between the input transformer pole and the output transformer pole by forming one or more conductive vias in the first substrate between the input transformer pole and the output transformer pole, fabricating one or more tuning elements on a second substrate, wherein the number of tuning elements corresponds to the number of filter poles between the input transformer pole and the output transformer pole, and bonding the second substrate to a top surface of the first substrate so that each tuning element on the second substrate is aligned with and overlays a filter pole on the first substrate.

22 Claims, 9 Drawing Sheets

METHOD FOR FABRICATING A MINIATURE TUNABLE FILTER

CROSS REFERENCE TO RELATED APPLICATIONS

This application is a continuation in part of U.S. patent application Ser. No. 11/166,032, filed Jun. 23, 2005, and claims the benefit of U.S. Provisional Patent Application Ser. No. 60/584,062, filed Jun. 29, 2004 for a "Miniature Tunable Filter" by Sarabjit Mehta and Peter Petre, which are incorporated herein by reference as though set forth in full.

BACKGROUND

1. Field

This disclosure relates generally to filters for electromagnetic signals and, more specifically, to tunable filters for use with radio frequency, microwave frequency, or millimeter wave frequency signals.

2. Description of Related Art

Filtering devices for filtering radio frequency, microwave frequency, and millimeter wave frequency signals are well known in the art. Strip line or planar microstrip filters are examples of filters used in microwave systems. These filters have the advantage of being relatively small but they also have a relatively high insertion loss and are typically not easily tunable.

Combline filters or Capacitively Loaded Interdigital Filters (CLIF) are also known in the art. These filters usually have a lower insertion loss than the strip line or planar microstrip filters, but combline filters or CLIFs are typically larger in size than the stripline or planar microstrip filters. Combline filters or CLIFs may not be tunable. Those combline filters or CLIFs that are tunable typically exhibit a response time on the order of milliseconds, due to the relatively large size of such filters. Also, the relatively large size of such filters typically requires fabrication using machine shop processing techniques, rather than wafer scale processing that is typically used for smaller electronic components.

SUMMARY

Embodiments of the present invention provide a method and apparatus for filtering electromagnetic signals. An embodiment of the present invention comprises a miniature tunable filter having a filter body made of a low loss dielectric material such as silicon or ceramic. Filter poles are disposed within the filter body and the filter poles are tuned by deflecting electrically conductive membranes that are suspended over the filter poles and that are separated from the filter poles by air or vacuum filled gaps. The disposition of flexible electrically conductive membranes over the poles allows the capacitive loading at the poles to be varied which allows the miniature filter to be tuned.

According to a first aspect a filter is disclosed comprising: a filter substrate; and one or more filter pole structures each filter pole structure comprising: a filter pole disposed within the filter substrate; a gap disposed above the filter pole; an electrically conductive membrane disposed above the filter pole and spaced from the filter pole by the gap the gap having a gap distance; and a tuning element disposed adjacent to the electrically conductive membrane, wherein the tuning element applies an electrostatic voltage to the electrically conductive membrane and the electrically conductive membrane changes the gap distance according to the applied electrostatic voltage.

According to a second aspect, a method of filtering is disclosed, comprising disposing one or more filter poles in a filter substrate; varying the capacitive loading of at least one filter pole of the one or more filter poles.

The tuning gaps may initially be very small, on the order of 8 μm, and the tuning process may vary the gaps by up to 10 μm or greater. The high sensitivity of the tuning process to the gap size allows the use of relatively small flexible membranes, for example, 1 mm×1 mm. The small size of the membranes also allows for a relatively fast response time, on the order of 1 to 10 μs or better.

A transformer structure may be used at the input and output of the filter, which may provide for optimization of the filter response.

Embodiments of the miniature filter according to the present invention are preferably manufactured using standard clean room processing and thin film deposition techniques. Such techniques may allow for the fabrication of large numbers of the miniature filters using wafer level processing.

A method for fabrication of a filter includes forming an input transformer pole in a first substrate by forming a first conductive via, forming an output transformer pole in the first substrate by forming a second conductive via, forming one or more filter poles in the first substrate between the input transformer pole and the output transformer pole by forming one or more conductive vias in the first substrate between the input transformer pole and the output transformer pole, fabricating one or more tuning elements on a second substrate, wherein the number of tuning elements corresponds to the number of filter poles between the input transformer pole and the output transformer pole, and bonding the second substrate to a top surface of the first substrate so that each tuning element on the second substrate is aligned with and overlays a filter pole on the first substrate.

Another method for fabrication of a plurality of filters includes forming a plurality of input transformer poles in a first substrate by forming a plurality of first conductive vias, forming a plurality of output transformer poles in the first substrate by forming a plurality of second conductive vias, each output transformer pole paired with one input transformer pole, forming one or more filter poles in the first substrate between each input transformer pole and output transformer pole pair by forming one or more conductive vias between the input transformer pole and the output transformer pole, fabricating tuning elements on a second substrate, wherein the number of tuning elements is the sum of the number of filter poles between each input transformer pole and output transformer pole pair, and bonding the second substrate to the top surface of the first substrate so that each tuning element on the second substrate is aligned with and overlays a filter pole on the first substrate.

BRIEF DESCRIPTION OF THE DRAWINGS

The features and advantages of the present disclosure will become better understood with regard to the following description, appended claims, and accompanying drawings.

DETAILED DESCRIPTION

Figure 1:
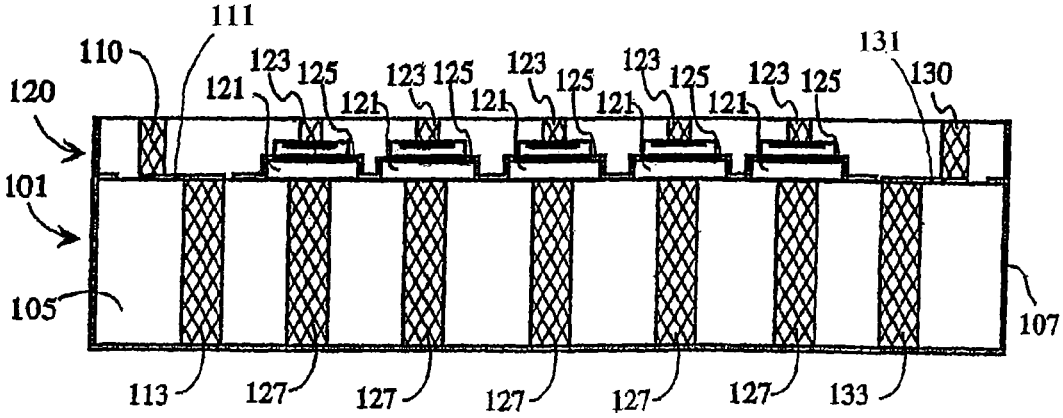
FIG. 1 shows a side view of a miniature tunable filter according to an embodiment of the present invention.

The present disclosure will now be described more fully hereinafter with reference to the accompanying drawings, in which preferred embodiments of the invention are shown. This disclosure may be embodied in many different forms and should not be construed as limited to the embodiments set forth herein. Further, the dimensions of certain elements shown in the accompanying drawings may be exaggerated to more clearly show details. The present disclosure should not be construed as being limited to the dimensional relations shown in the drawings, nor should the individual elements shown in the drawings be construed to be limited to the dimensions shown.

A miniature tunable filter according to an embodiment of the present invention is depicted in FIG. 1. The tunable filter comprises a filter body 101 that is preferably made from a high $\in_r$ substrate 105, such as low loss silicon or ceramic. Use of such substrates allows the overall size of the filter to be kept small. Filter poles 127 are disposed within the filter body 101 and are preferably surrounded by the substrate material. The filter poles 127 are made of an electrically conductive material, preferably gold or silver, although other conductive materials may be used. Sidewalls 107 are preferably disposed on at least some of the sides of the filter body 101. The sidewalls also preferably comprise an electrically conductive material.

The upper portion of the filter comprises flexible metallized membranes 125 that are suspended over the filter poles 127 and that are separated from the filter poles 127 by air or vacuum filled gaps 121. The membranes 125 and associated structures are preferably fabricated on a separate substrate 120 utilizing a process described in U.S. patent application Ser. No. 10/786,824, filed on Feb. 24, 2004 and titled "Process for Fabricating Monolithic Membrane Substrate Structures with Well-Controlled Air Gaps," incorporated herein by reference. The process described in U.S. patent application Ser. No. 10/786,824 provides a monolithic membrane-substrate structure. According to an embodiment of the present invention, this monolithic substrate can be metallized and bonded to the top of the filter body 101 to form the air or vacuum filled gaps 121. Tuning elements 123 receive voltages that are preferably on the order of 0-400 V or 200-400V. Application of these voltages at the tuning elements 123 cause the flexible membranes 125 to deflect due to the electrostatic effect. The deflection of the flexible membranes 125 change the capacitive loading at the filter poles 127, thereby tuning the filter.

Therefore, the structure or filter disclosed in FIG. 1 is hybrid one, because it is in part air- or vacuum-filled (gaps 121) and in part dielectric-filled (silicon or ceramic substrate 105).

Figure 2:
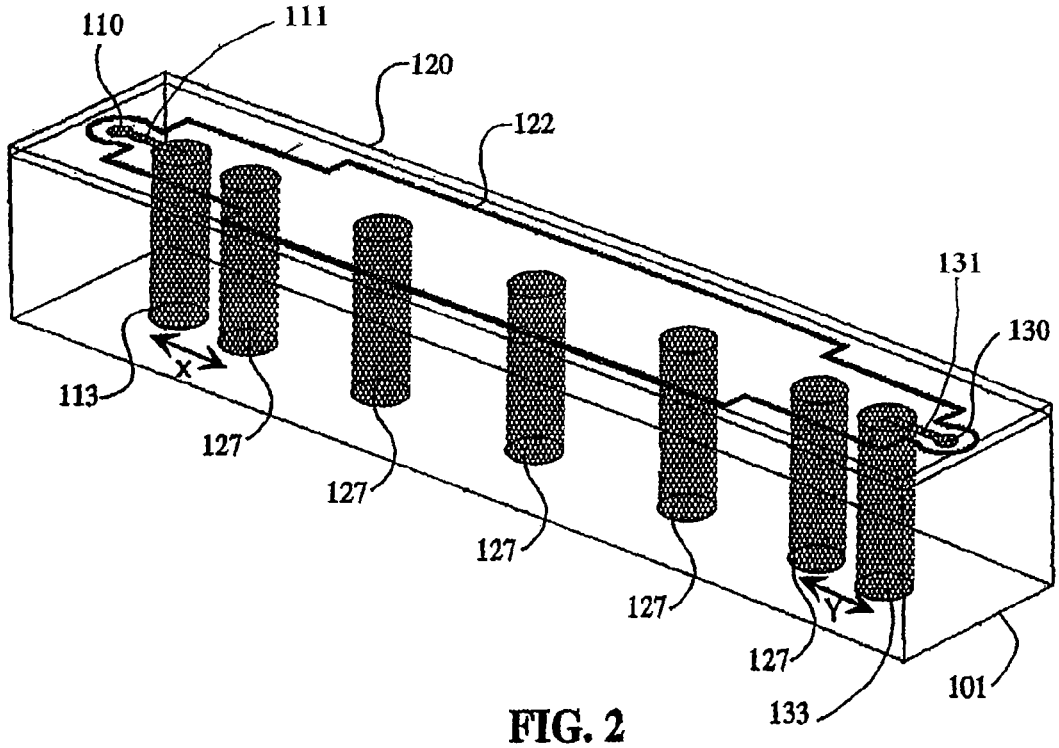
FIG. 2 shows a perspective view of the miniature tunable filter shown in FIG. 1.

FIG. 2 shows a perspective view of the tunable filter depicted in FIG. 1. FIG. 2 shows the general outline 122 of the portions of the separate substrate on which the flexible metallized membranes 125 and the tuning element 123 have been fabricated. In FIG. 2, an input electrical signal may be coupled to an input contact line 110 and the signal output from the filter will be present at an output contact line 130. As noted above, filters according to embodiments of the present invention may be quite small, on the order of 2 mm×2 mm×10 mm, or smaller.

In a preferred embodiment according to the present invention, transformer poles 113, 133 are used to couple electric signals into and out of the filter. Preferably, an input transformer pole 113 is electrically coupled to the input contact line 110 and an output transformer pole 133 is coupled to the output contact line 130. The input transformer pole 113 is spaced apart from the nearest filter pole 127 by a distance "X" and the output transformer pole 133 is spaced apart from the nearest filter pole 127 by a distance "Y" as shown in FIG. 2. By varying either the distance "X" or the distance "Y" or both, the Q of the filter and, hence, the overall response of the filter, can be optimized to the desired specifications. Since the input contact line 110 and the output contact line 130 are planar with the top of the filter body 101, standard clean room processing and thin film deposition techniques may be used to provide the coupling to the input and output transformer poles 113, 133. An alternative approach to provide the desired Q would be to tap the input and/or output lines to the transformer or filter poles at some depth within the filter body.

Therefore, the device and method according to the present disclosure are compatible with planar processing and, differently from conventional methods, allow large scale (wafer level) fabrication.

Further, the input transformer pole 113 and the output transformer pole 133 allow the Q of the tunable device to be controlled by variation of the distance between the transformer poles and the nearest filter poles, such that subsequent fabrication steps are compatible with planar processing.

The embodiment of the present invention depicted in FIGS. 1 and 2 show six filter poles. Those skilled in the art will understand that other embodiments according to the present invention may be implemented with more than or fewer than six filter poles. Those skilled in the art will also understand that while FIGS. 1 and 2 depict a filter pole layout similar to a combline design, other embodiments according to the present invention may use a filter pole layout similar to a CLIF design.

The fabrication of miniature combine filters is compatible with wafer level processing, which enables 100 to 1000 filter devices to be made on a standard 3" to 4" diameter semiconductor substrate. A substrate should be preferably a low loss semiconductor substrate, such as silicon or ceramic, and have a thickness range of 5 to 80 mils.

Figure 3A:
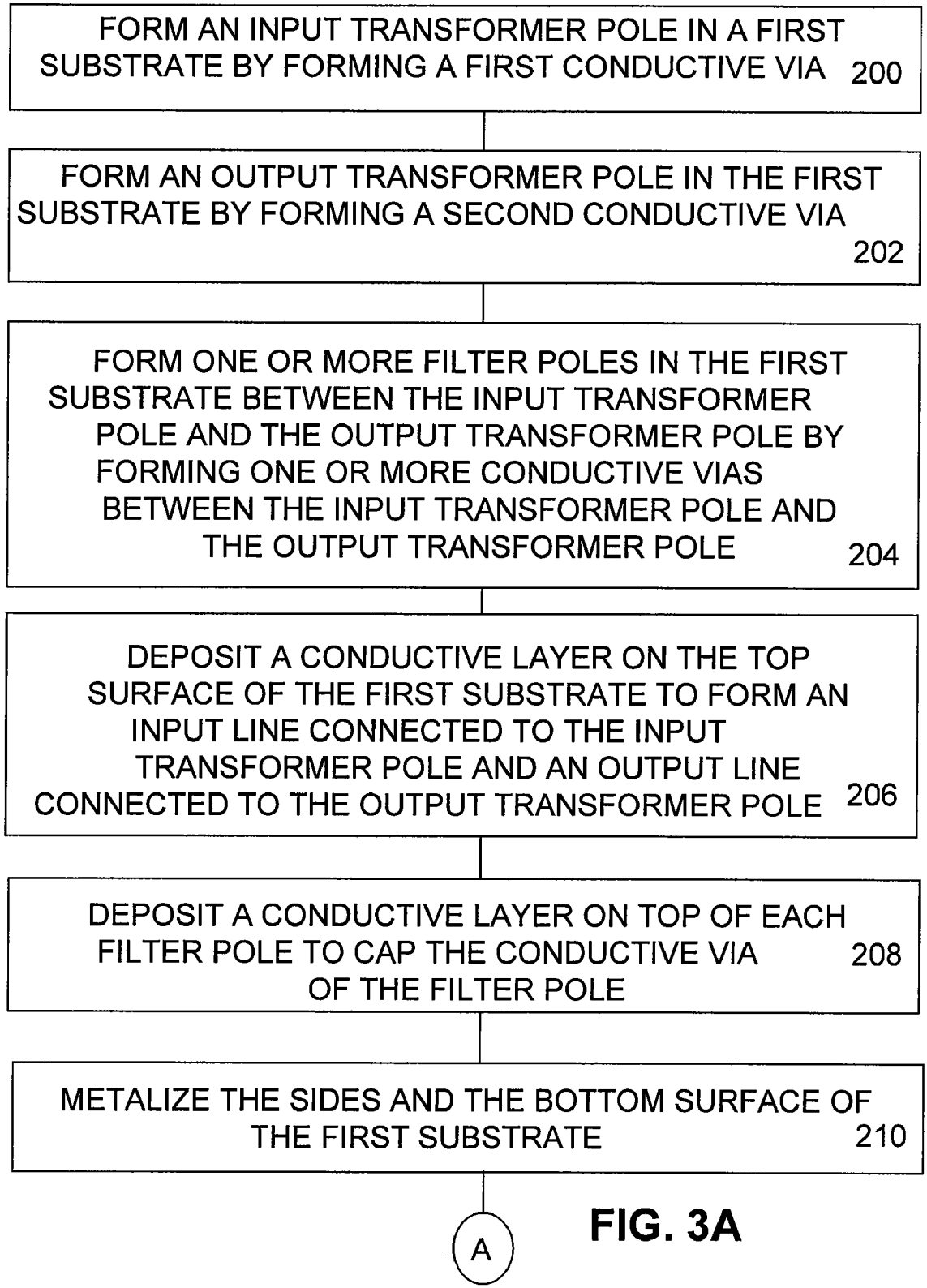
FIGS. 3A and 3B are flow charts of a method for fabricating a filter according to the present disclosure.
Figure 3B:
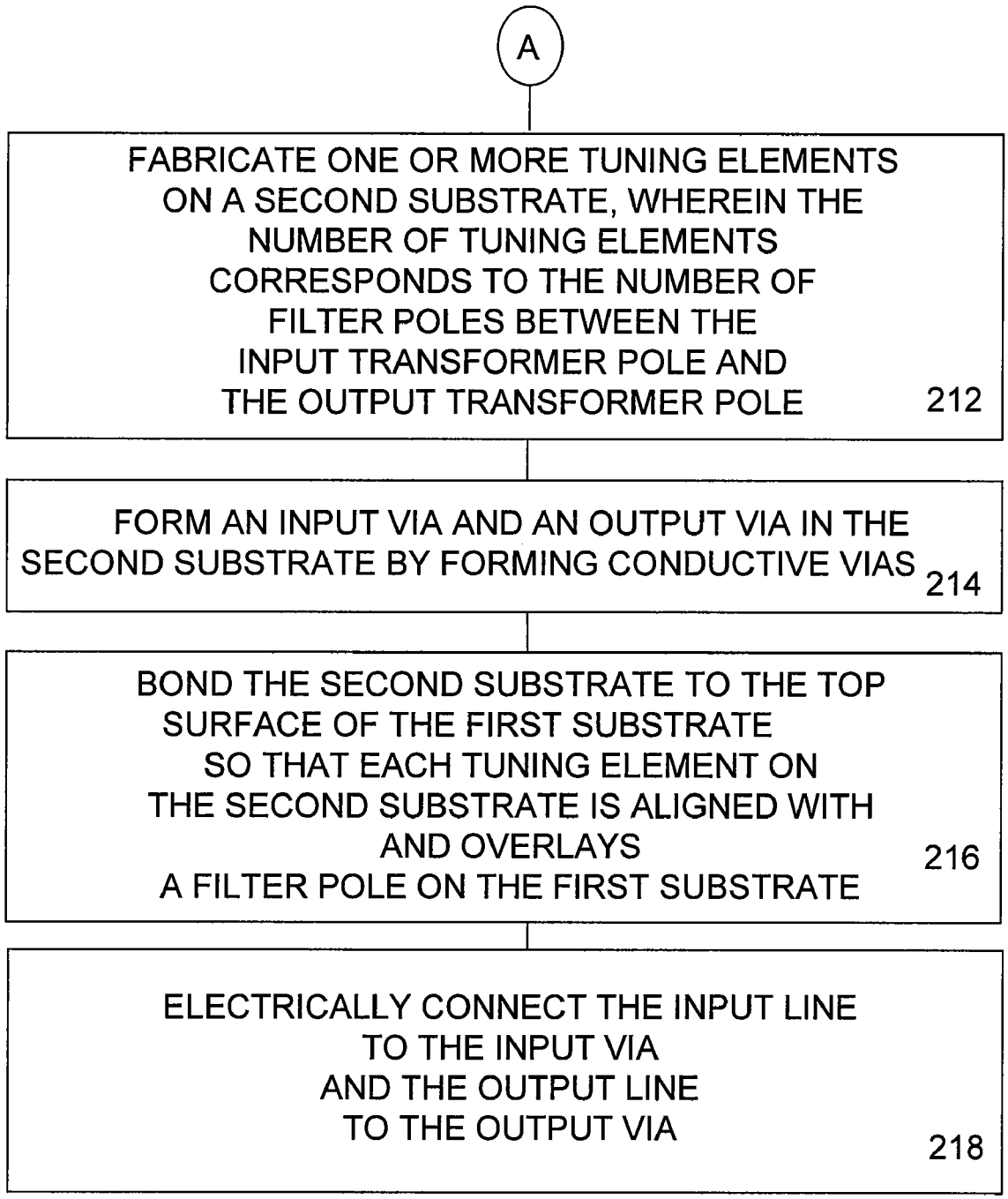

FIGS. 3A and 3B are flowcharts of an exemplary method for fabricating a filter. In step 200 an input transformer pole 113 in a first substrate 105 may be formed by forming a first conductive via. To form a conductive via, a hole may be formed in the first substrate 105 by micromachining, which may be performed by laser machining or drilling. In another exemplary embodiment etching methods can be used to form the holes. Then each hole is filled with a conductive material such as conductive epoxy or silver based paste. Then in step 202 an output transformer pole 133 in the first substrate 105 is formed by forming a second conductive via. Then in step 204 one or more filter poles 127 are formed in the first substrate between the input transformer pole 113 and the output transformer pole 133 by forming one or more conductive vias between the input transformer pole 113 and the output transformer pole 133. Then in step 206 a conductive layer, which can for example be gold (AU), is deposited on the top surface of the first substrate 105 to form an input line 111 connected to the input transformer pole 113 and an output line 131 connected to the output transformer pole 133. Then in step 208 a conductive layer, which can also be gold, is deposited on top of each filter pole to cap the conductive via of the filter pole. Then in step 210 the sides and the bottom surface of the first substrate are metalized to form a filter body 101. The metallization can be gold.

In step 212 one or more tuning elements 123 are fabricated on a second substrate 120, wherein the number of tuning elements corresponds to the number of filter poles 127 between the input transformer pole 113 and the output transformer pole 133. The second substrate 120 can be of the same material as the first substrate. The tuning elements 123 are further described below in reference to FIGS. 6A and 6B. In step 214 a conductive input via 110 and an output conductive via 130 are formed in the second substrate 120. In step 216 the second substrate 120 is bonded to the top surface of the first substrate 105 so that each tuning element on the second substrate 120 overlays a filter pole 127 on the first substrate 105. Then in step 218 the input line 111 is electrically connected to the input conductive via 110 and the output line 131 is electrically connected to the output conductive via 130. In one exemplary embodiment, the electrical connection between input line 111 and input conductive via 110 and between the output line 131 and the output conductive via 130 may be formed when the first and second substrates are bonded together in step 216.

Figure 4:
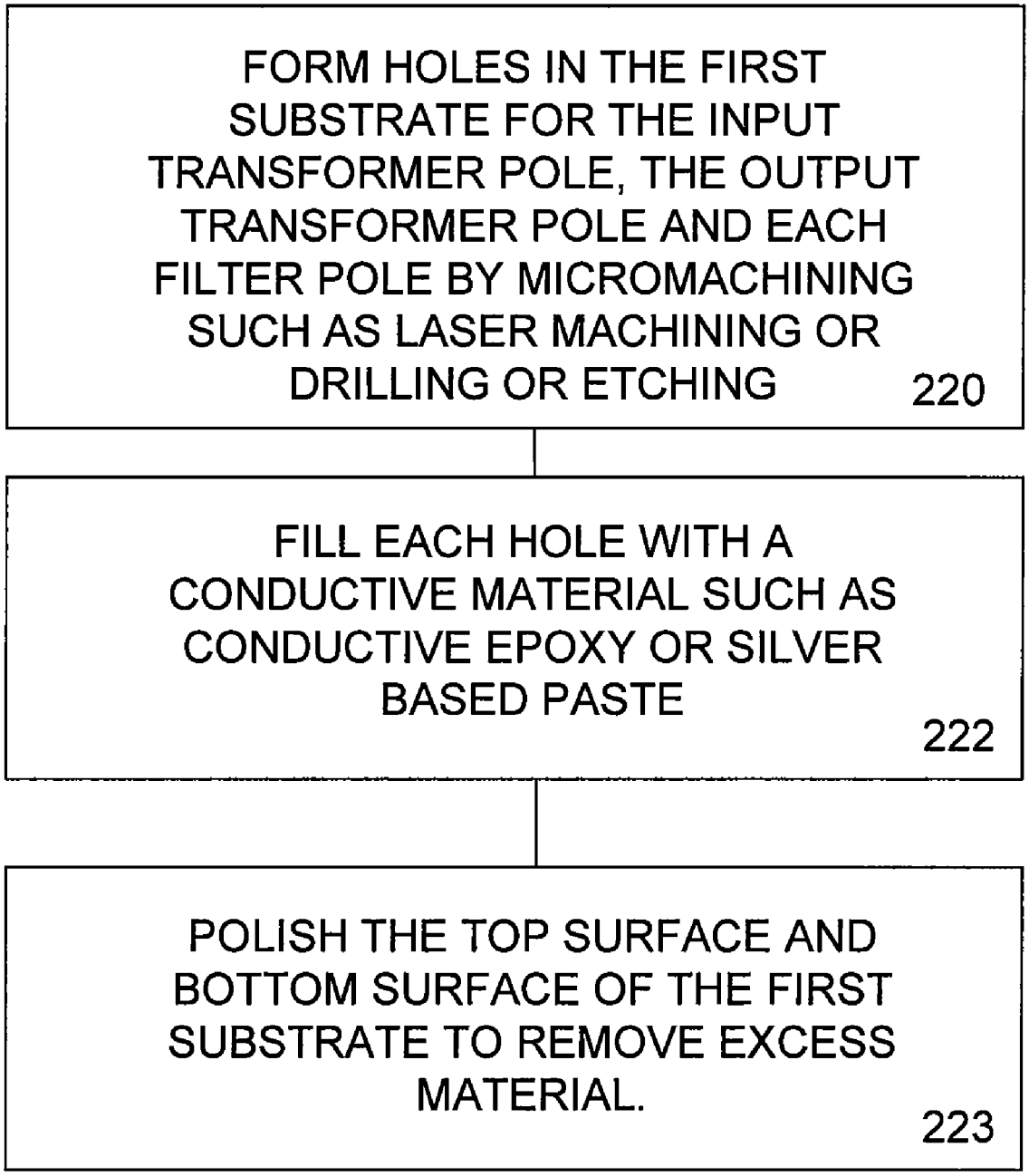
FIG. 4 is a flow chart of a portion of a method for fabricating a filter according to the present disclosure.

FIG. 4 is one exemplary method for forming the conductive vias in the first substrate 105. In step 220 holes are formed in the first substrate for the input transformer pole 113, the output transformer pole 133 and each filter pole 127 by micromachining using for example laser machining or drilling. In another exemplary method etching may be used to form the holes. In step 222 each hole may be filled with a conductive material such as conductive epoxy or silver based paste. Then in step 223 the top and bottom surfaces of the first substrate 105 may be polished to remove any excess material.

Figure 5:
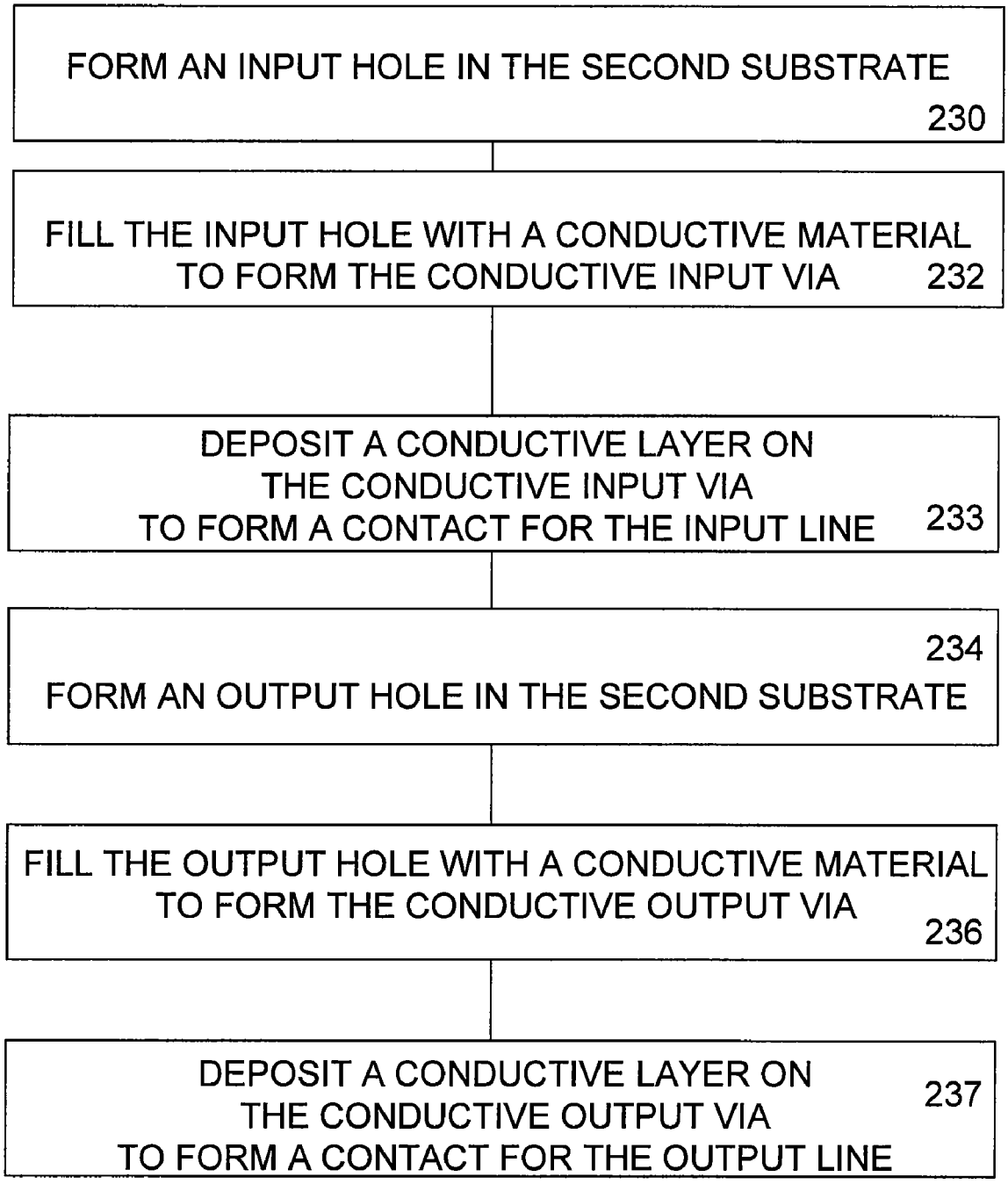
FIG. 5 is a flow chart of another portion of a method for fabricating a filter according to the present disclosure.

FIG. 5 is a method for forming the conductive input via 110 and the conductive output via 130 in the second substrate 120 in step 210. In step 230 an input hole may be formed in the second substrate 120 by micromachining or etching, as discussed in reference to FIG. 4. Then in step 232 the input hole may be filled with a conductive material such as conductive epoxy or silver based paste. Polishing can be performed to remove any excess material. In step 233 a conductive layer is deposited on the filled input hole to form a contact with the input line 111 on the first substrate 105, when the first and second substrates are bonded together. The conductive layer can be gold (Au). Similarly for the conductive output via 130, in step 234 an output hole may be formed in the second substrate 120 and in step 236 the output hole may be filled with conductive material. In step 237 a conductive layer is deposited on the filled output hole to form a contact with the output line 130 on the first substrate 105, when the first and second substrates are bonded together. Again polishing may be performed to remove excess material and the conductive layer can be gold.

Figure 6A:
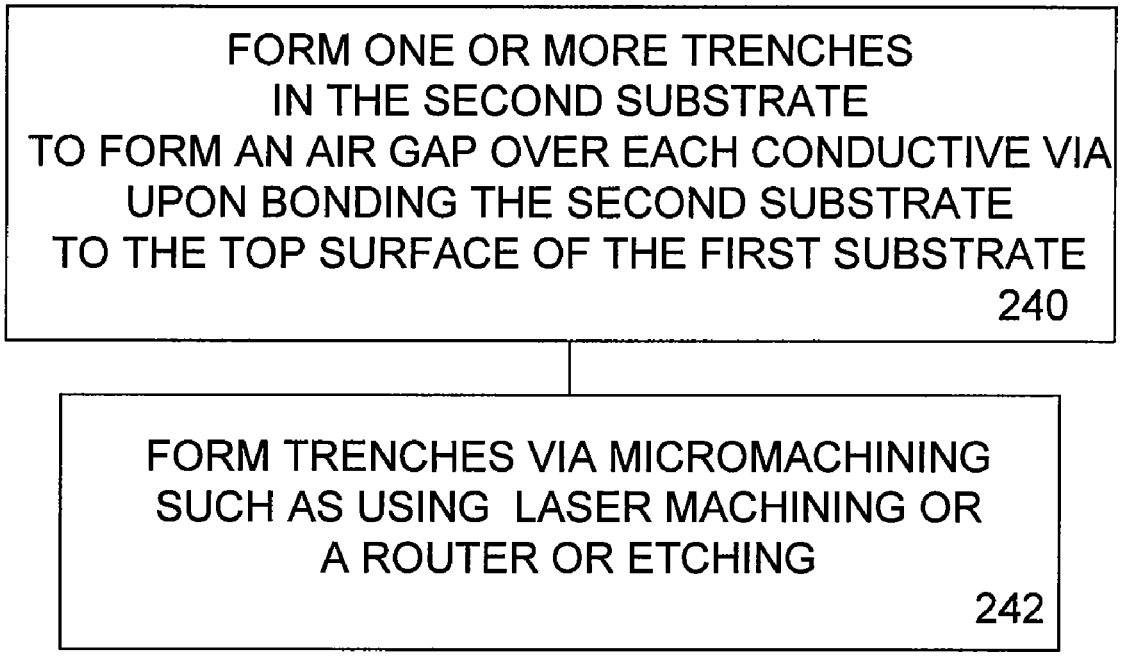
FIGS. 6A and 6B are methods for fabricating a tuning element according to the present disclosure.

FIG. 6A is an exemplary method for fabricating the tuning elements 123 described in step 208 of FIG. 3. In step 240 one or more trenches (not shown) are formed in the second substrate 120 so that an air gap is formed over each conductive via 127 when the second substrate 120 is bonded to the top surface of the first substrate 105 in step 212. In step 242 the trenches may be formed via micromachining, such as laser machining or by using a router, or by etching. This method of forming tuning elements 123 is most appropriate for fixed tuned filters. The filter is tuned according to the depth of the trenches.

Figure 6B:
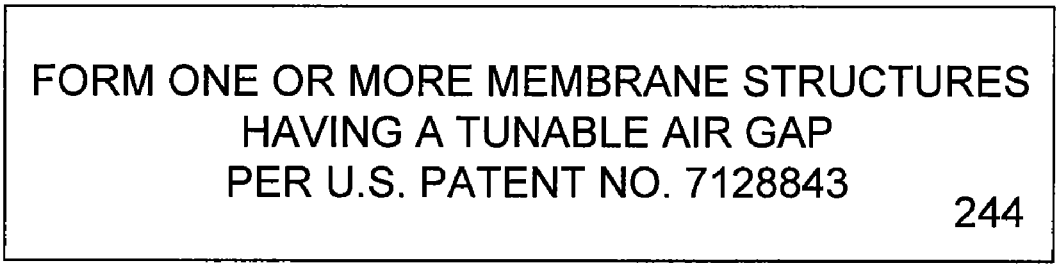

Another exemplary method of forming the tuning elements 123 is to form membrane structures having tunable air gaps, as shown in step 244 in FIG. 6B, according to the method disclosed in U.S. Pat. No. 7,128,843 issued Oct. 31, 2006 to Sarabjit Mehta and titled "Process for Fabricating Monolithic Membrane Substrate Structures with Well-Controlled Air Gaps," incorporated herein by reference. In Mehta, a process for fabricating monolithic membrane structures having air gaps is disclosed, comprising the steps of: providing a wafer; depositing and patterning a protective layer on the wafer; providing a trench in the wafer; depositing and patterning a metal in the trench; depositing and patterning a sacrificial layer on the metal; depositing and patterning a membrane pad on the sacrificial layer; providing a polymeric film on the protective layer and sacrificial layer, wherein part of the polymeric film has a tensile stress; and releasing part of the polymeric film from the protective layer and sacrificial layer, wherein the tensile stress of a portion of the polymeric film releases the portion of the polymeric film from the wafer and generates the air gap. The tunable air gaps are described above with reference to FIGS. 1 and 2 and flexible metalized membranes 125.

Figure 7A:
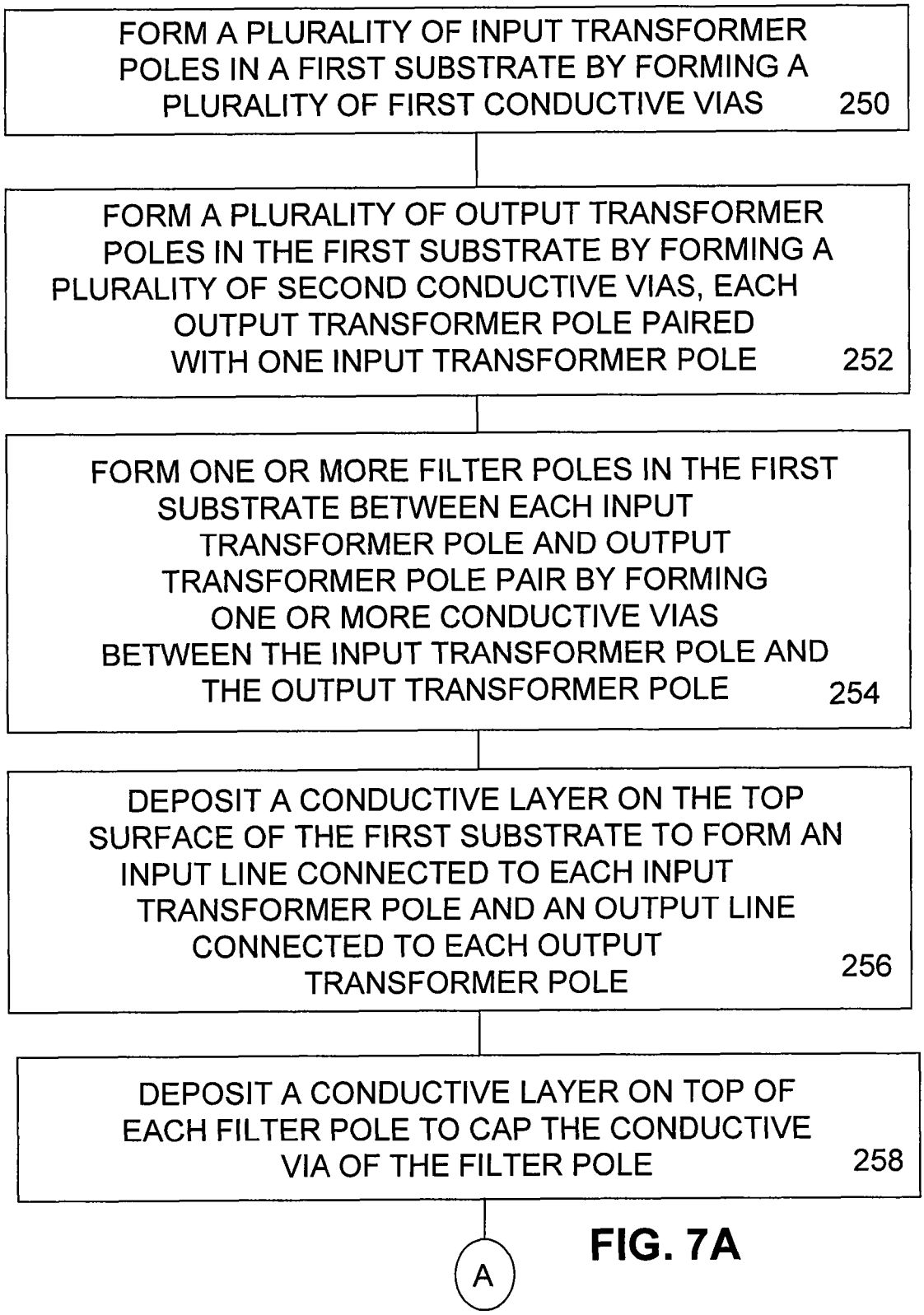
FIGS. 7A, 7B and 7C are flow charts of another method for fabricating a filter according to the present disclosure.
Figure 7B:
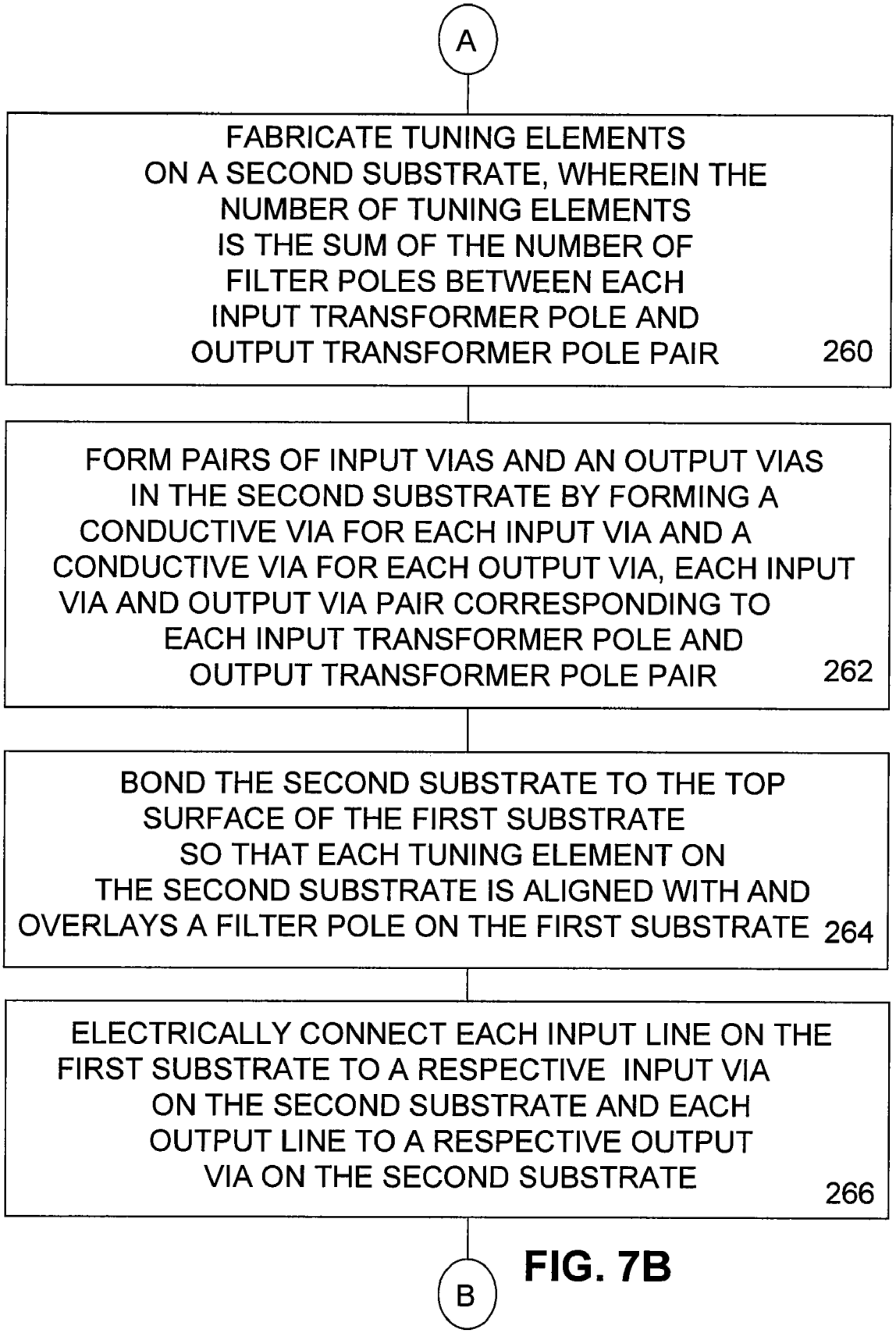
Figure 7C:
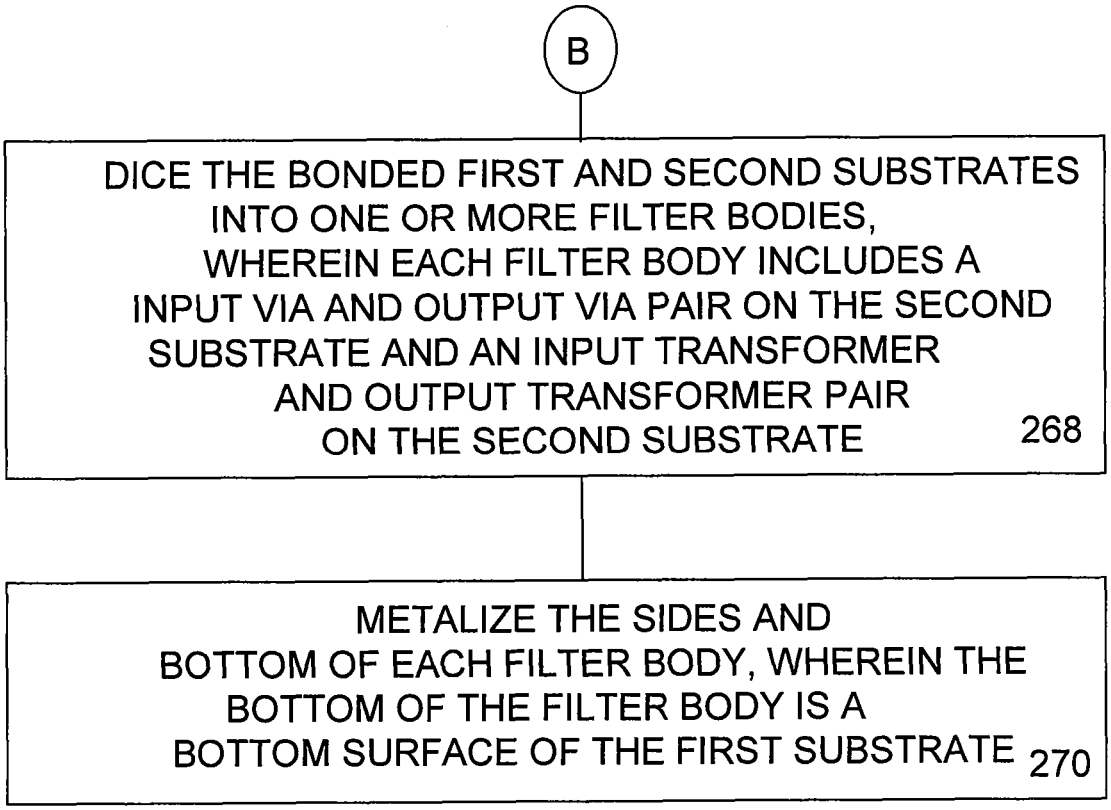

The methods of this disclosure can be used to fabricate 1 to 1000 filters or more simultaneously, as shown in the flow charts of FIGS. 7A, 7B and 7C. In step 250, a plurality of input transformer poles 113 are formed in a first substrate 105 by forming a plurality of first conductive vias. Then in step 252, a plurality of output transformer poles 133 in the first substrate 105 are formed by forming a plurality of second conductive vias, wherein each output transformer pole is paired with one input transformer pole. In step 254 one or more filter poles 127 are formed in the first substrate 105 between each input transformer pole 113 and output transformer pole 133 pair by forming one or more conductive vias between the input transformer pole and the output transformer pole. In step 256 a conductive layer may be deposited on the top surface of the first substrate to form an input line 111 connected to each input transformer pole 113 and an output line 131 connected to each output transformer pole 133. Then in step 258 a conductive layer may be deposited on top of each filter pole 127 to cap the conductive via of the filter pole 127.

In step 260, tuning elements 123 are fabricated on a second substrate 120. The number of tuning elements is the sum of the number of filter poles 127 between each input transformer pole 113 and output transformer pole 133 pair. In step 262 pairs of input conductive vias 110 and an output conductive vias 130 are formed in the second substrate 120 by forming a conductive via for each input conductive via 110 and a conductive via for each output conductive via 130, each input conductive via 110 and output conductive via 130 pair corresponding to each input transformer pole 113 and output transformer pole pair 133. In step 264 the second substrate 120 is bonded to the top surface of the first substrate 105, so that each tuning element 123 on the second substrate 120 is aligned with and overlays a filter pole 127 on the first substrate 105. Then in step 266 each input line 111 on the first substrate 105 is electrically connected to a respective input conductive via 110 on the second substrate 120 and each output line 131 on the first substrate 105 to a respective output conductive via 130 on the second substrate 120. In step 268 the bonded first and second substrates are diced into one or more filter bodies. Each filter body includes an input conductive via 110 and output conductive via 130 pair on the second substrate 120 and an input transformer pole 113 and an output transformer pole 133 pair on the first substrate 105. Then in step 270 the sides and bottom of each filter body are metalized. The bottom of the filter body is a bottom surface of the first substrate 105.

The foregoing detailed description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "step(s) for . . . . "

What is claimed is:

1. A method for fabrication of a filter, the method comprising:

forming an input transformer pole in a first substrate by forming a first conductive via;

forming an output transformer pole in the first substrate by forming a second conductive via;

forming one or more filter poles in the first substrate between the input transformer pole and the output transformer pole by forming one or more conductive vias in the first substrate between the input transformer pole and the output transformer pole;

fabricating one or more tuning elements on a second substrate, wherein the number of tuning elements corresponds to the number of filter poles between the input transformer pole and the output transformer pole; and bonding the second substrate to a top surface of the first substrate so that each tuning element on the second substrate is aligned with and overlays a filter pole on the first substrate and wherein a gap is disposed between each tuning element and corresponding filter pole.

2. The method of claim 1, the method further comprising:

forming an input line on a top surface of the first substrate connected to the input transformer pole;

forming an output line on the top surface of the first substrate connected to the output transformer pole;

forming an input conductive via in the second substrate;

forming an output conductive via in the second substrate;

electrically connecting the input line to the input conductive via; and electrically connecting the output line to the output conductive via.

3. The method of claim 1, the method further comprising:

metalizing a bottom surface and sides of the first substrate.

4. The method of claim 2 wherein:

the steps of forming an input transformer pole, forming an output transformer pole, and forming one or more filter poles in the first substrate comprise:

forming one or more holes in the first substrate;

filling each hole with a conductive material; and polishing the top surface and a bottom surface of the first substrate to remove excess material;

the step of forming an input conductive via in the second substrate comprises:

forming an input hole in the second substrate;

filling the input hole with the conductive material to form the conductive input via; and depositing a first conductive layer on the conductive input via to form a contact for the input line; and the step of forming an output conductive via in the second substrate comprises:

forming an output hole in the second substrate;

filling the output hole with the conductive material to form the conductive output via; and depositing a second conductive layer on the conductive output via to form a contact for the output line.

5. The method of claim 4 wherein the step of forming one or more holes in the first substrate comprises drilling, etching or laser machining.

6. The method of claim 4 wherein the conductive material comprises conductive epoxy or silver based paste.

7. The method of claim 1 wherein the step of fabricating one or more tuning elements comprises forming one or more trenches in the second substrate to form an air gap over each filter pole upon bonding the second substrate to the top surface of the first substrate.

8. The method of claim 7 wherein the step of forming a trench comprises laser machining or etching.

9. The method of claim 1 wherein the step of fabricating one or more tuning elements comprises forming one or more membrane structures having an air gap.

10. The method of claim 9 wherein each membrane structure comprises a tunable air gap.

11. A method for fabrication of a plurality of filters, the method comprising:

forming a plurality of input transformer poles in a first substrate by forming a plurality of first conductive vias;

forming a plurality of output transformer poles in the first substrate by forming a plurality of second conductive vias, each output transformer pole paired with one input transformer pole;

forming one or more filter poles in the first substrate between each input transformer pole and output transformer pole pair by forming one or more conductive vias between the input transformer pole and the output transformer pole;

fabricating tuning elements on a second substrate, wherein the number of tuning elements is the sum of the number of filter poles between each input transformer pole and output transformer pole pair; and bonding the second substrate to the top surface of the first substrate so that each tuning element on the second substrate is aligned with and overlays a filter pole on the first substrate and wherein a gap is disposed between each tuning element and corresponding filter pole.

12. The method of claim 11 further comprising:

forming an input line on a top surface of the first substrate connected to each input transformer pole;

forming an output line on the top surface of the first substrate connected to each output transformer pole;

forming pairs of input conductive vias and output conductive vias in the second substrate, each input conductive via and output conductive via pair corresponding to each input transformer pole and output transformer pole pair; and electrically connecting each input line on the first substrate to a respective input conductive via on the second substrate and each output line to a respective output conductive via on the second substrate.

13. The method of claim 11 further comprising:

dicing the bonded first and second substrates into one or more filter bodies, wherein each filter body includes an input conductive via and output conductive via pair on the second substrate and an input transformer and output transformer pair on the first substrate; and metalizing a bottom surface and side surfaces of each filter body, wherein the bottom surface of the filter body is a bottom surface of the first substrate.

14. The method of claim 12 wherein:

the steps of forming input transformer poles, forming output transformer poles, and forming one or more filter poles in the first substrate comprise:

forming one or more holes in the first substrate;

filling each hole with a conductive material; and polishing the top surface and a bottom surface of the first substrate to remove excess material;

the step of forming input conductive vias in the second substrate comprises:

forming an input hole in the second substrate;

filling the input hole with the conductive material to form the conductive input via; and depositing a first conductive layer on the conductive input via to form a contact for the input line; and the step of forming an output conductive vias in the second substrate comprises:

forming an output hole in the second substrate;

filling the output hole with the conductive material to form the conductive output via; and depositing a second conductive layer on the conductive output via to form a contact for the output line.

15. The method of claim 14 wherein the step of forming one or more holes in the first substrate comprises drilling, etching or laser machining.

16. The method of claim 14 wherein the conductive material comprises conductive epoxy or silver based paste.

17. The method of claim 11 wherein the step of fabricating one or more tuning elements comprises forming one or more trenches in the second substrate to form an air gap over each filter pole upon bonding the second substrate to the top surface of the first substrate.

18. The method of claim 14 wherein the step of forming a trench comprises laser machining or etching.

19. The method of claim 11 wherein the step of fabricating one or more tuning elements comprises forming one or more membrane structures having an air gap.

20. The method of claim 19 wherein each membrane structure comprises a tunable air gap.

21. The method of claim 1 wherein each gap comprises an air or vacuum filled gap.

22. The method of claim 11 wherein each gap comprises an air or vacuum filled gap.

* * * * *

UNITED STATES PATENT AND TRADEMARK OFFICE

CERTIFICATE OF CORRECTION

PATENT NO. : 7,861,398 B1
APPLICATION NO. : 12/142580
DATED : January 4, 2011
INVENTOR(S) : Sarabjit Mehta and Peter Petre It is certified that error appears in the above-identified patent and that said Letters Patent is hereby corrected as shown below:

Col. 1 Line 3 insert,

--STATEMENT REGARDING FEDERALLY SPONSORED RESEARCH OR DEVELOPMENT

The present invention was made with support from the United States Government under Contract No. N00014-02C-0478 awarded by the Department of the Navy, Office of Naval Research. The U.S. Government has certain rights in the invention.--

Signed and Sealed this
Ninth Day of August, 2011

David J. Kappos

David J. Kappos
*Director of the United States Patent and Trademark Office*